United States Patent [19]

Franks, Jr.

[11] Patent Number: 5,015,205

[45] Date of Patent: May 14, 1991

[54] CABLE CLAMP

[76] Inventor: George J. Franks, Jr., 664 Thompson Cir., Inverness, Ill. 60067

[21] Appl. No.: 432,637

[22] Filed: Nov. 7, 1989

[51] Int. Cl.[5] ..... H01R 4/30

[52] U.S. Cl. ..... 439/803; 24/135 L; 411/400

[58] Field of Search ..... 439/807, 803, 100, 778, 439/779; 24/135 L; 411/400, 401, 222; 248/61, 74.1; 403/385, 398

[56] References Cited

U.S. PATENT DOCUMENTS

| | | | |
|---|---|---|---|
| 811,907 | 2/1906 | Dossert | 439/803 |
| 895,545 | 8/1908 | Fahnestock | 24/135 L |
| 1,013,521 | 1/1912 | Swenson | 411/222 |
| 1,026,472 | 5/1912 | Smith | 411/222 |
| 1,677,783 | 7/1928 | Kearney | 439/778 |
| 1,718,751 | 6/1929 | Matthes | 24/135 L |
| 3,985,411 | 10/1976 | Mooney et al. | 439/791 |
| 4,863,390 | 9/1989 | Cera et al. | 439/100 |

FOREIGN PATENT DOCUMENTS

| | | | |
|---|---|---|---|
| 398768 | 9/1973 | U.S.S.R. | 248/74.1 |
| 539594 | 9/1941 | United Kingdom | 439/733 |
| 1521039 | 8/1978 | United Kingdom | 411/400 |

OTHER PUBLICATIONS

Senior Industries Catalog, p. 9.

*Primary Examiner*—Gary F. Paumen
*Attorney, Agent, or Firm*—Jenner & Block

[57] ABSTRACT

An improved telephone cable lashing wire clamp provides a mechanical connection between a telephone cable messenger wire and a telephone cable lashing wire. A hook member engages the messenger wire and a messenger wire retaining nut secures the messenger wire to the hook member. A lashing wire jam nut then secures the wire lashing wire between the messenger wire retaining nut and the lashing wire jam nut. The hook member accepts a variety of messenger wire diameters, and can be a variety of different shapes. A variety of contacting surfaces can be used on the hook portion and the messenger wire retaining nut to contact the messenger wire.

19 Claims, 2 Drawing Sheets

Fig. 1
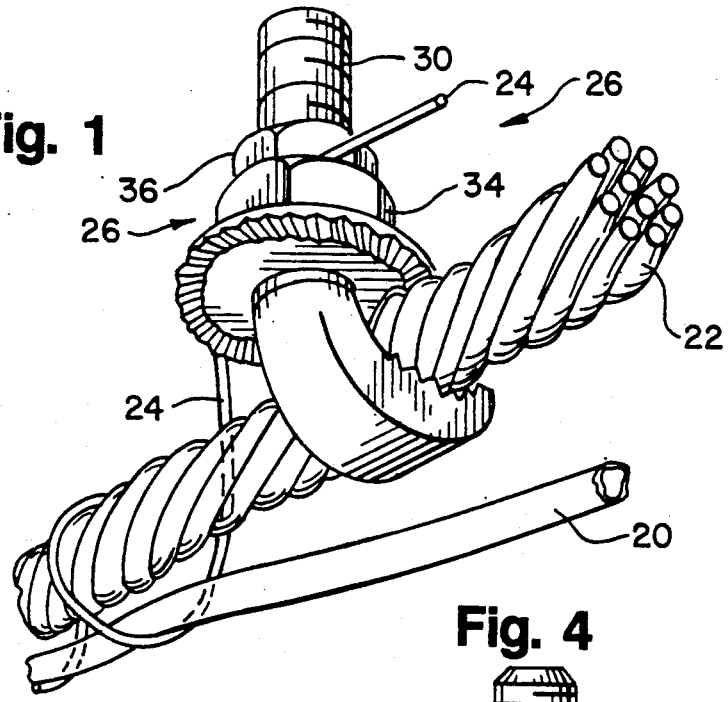
Fig. 2
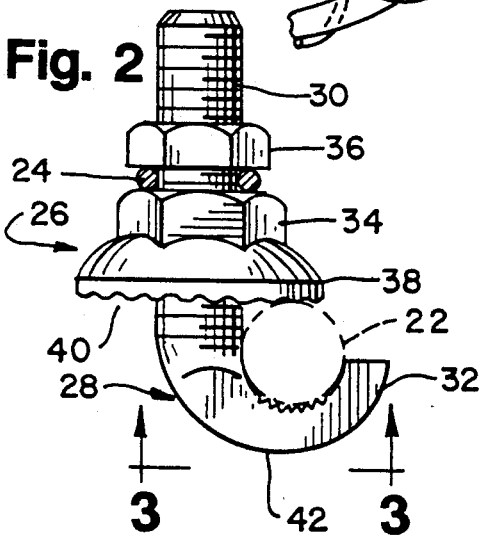
Fig. 4
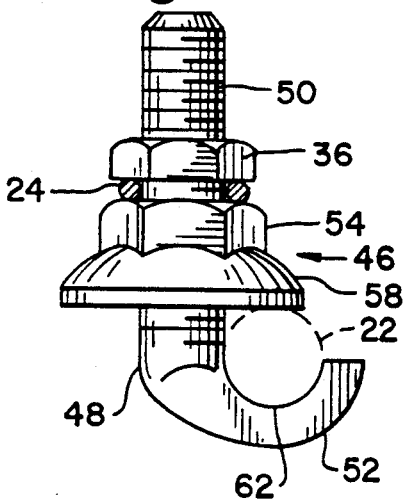
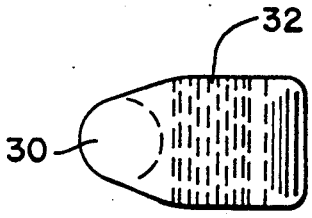
Fig. 3
Fig. 5
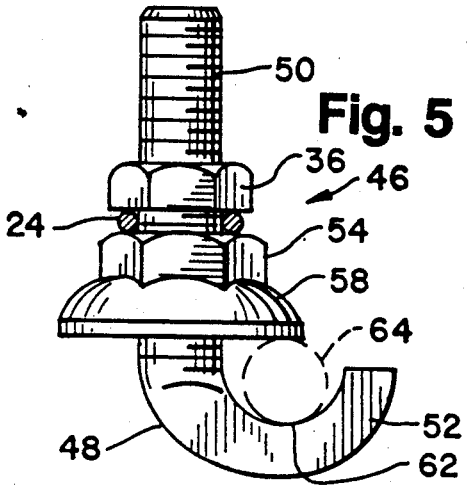

Fig. 6
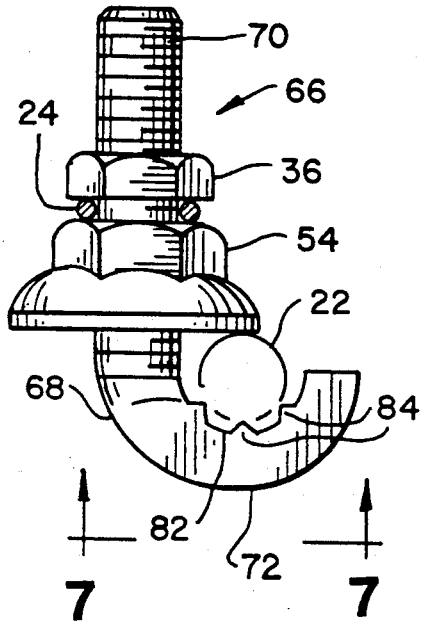
Fig. 8
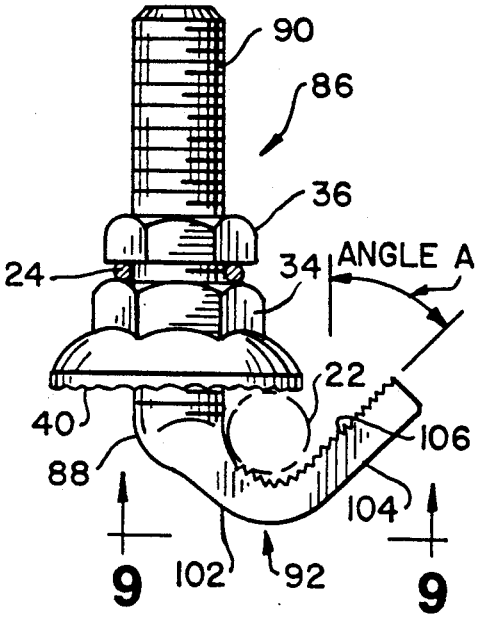
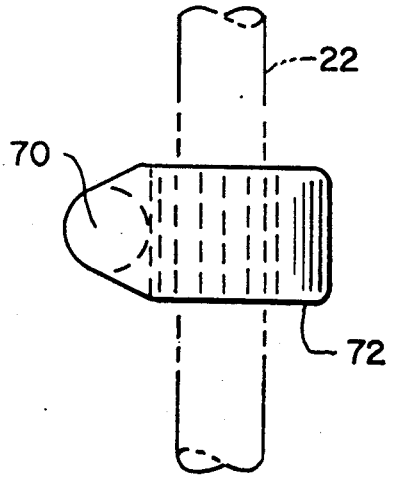
Fig. 7
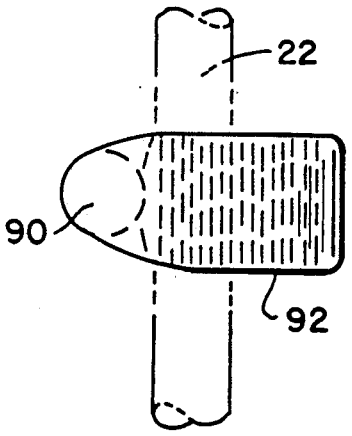
Fig. 9

CABLE CLAMP

FIELD OF THE INVENTION

This invention relates to a cable clamp used to provide a mechanical connection between a telephone messenger wire and a telephone lashing wire.

BACKGROUND OF THE INVENTION

Several situations exist in which it is necessary to provide a mechanical connection between a mechanical support wire and a lashing wire used to secure a signal cable thereto.

An example of such an application would be providing telephone service to a building. Typically, a messenger wire is mechanically secured between a telephone pole and a service entrance at the building. This messenger wire provides the mechanical support for a signal wire which provides the telephone signal to the building. The signal wire is attached to the messenger wire by means of a lashing wire which is wrapped around the signal wire and the messenger wire. The lashing wire must then be secured to the messenger wire to prevent the lashing wire from unwinding.

A typical cable clamp used for securing a lashing wire to a messenger wire contains a relatively large number of individual components compared to the present invention. One such clamp is the Senior clamp comprises two specially formed plates held together by a double-ended stud and two bolts. The messenger wire is retained between recesses found on the inner surface of the formed plates. The lashing wire is retained between two washers located between the outer surface of one of the plates and one of the retaining nuts.

While a cable clamp such as that described above provides good mechanical connection between the messenger and lashing wire, several disadvantages have been discovered.

First, the relatively large number of parts itself causes disadvantages. As the parts count increases, both the clamp weight and clamp cost will increase.

Another disadvantage arises because the clamp cannot be tightened on the messenger wire until the lashing wire is positioned between the lashing wire retaining washers. Such a design requires the installer to hold the messenger wire retaining plates onto the messenger wire while attempting to position the lashing wire between the washers. The entire clamp assembly must then be held in position while the installer tightens one of the nuts. This makes installation difficult, especially when an installer is balanced on a pole or ladder.

Yet another disadvantage arises because the messenger wire held by such a clamp must generally conform to the diameter of the recess formed by the grooves in the formed plates. This prevents the clamp from being used with cables having a diameter substantially different from the diameter between the formed plate grooves.

A need exists for a telephone cable clamp that has fewer parts and overcomes the other disadvantages previously described.

SUMMARY OF THE INVENTION

In accordance with the present invention, a novel clamp device is disclosed which provides improved installation characteristics with lower unit cost and weight than that found in the prior art. This clamp also provides the ability to accommodate several different sizes of messenger wire.

The cable clamp device includes a hook member containing a jaw portion and a threaded shank portion, a messenger wire retaining nut, and a lashing wire jam nut. The messenger wire, such as a telephone messenger wire, is first retained within the hook member by depressing the messenger wire within the jaw portion of the hook member and tightening the messenger wire retaining nut along the threaded shank portion of the hook member against the messenger wire. This secures the messenger wire between the hook member and the messenger wire retaining nut. A lashing wire, such as a telephone lashing wire, is then attached between the messenger wire retaining nut and the lashing wire jam nut by first wrapping or otherwise placing the lashing wire around the exposed threaded shank portion of the hook member between the messenger wire retaining nut and the lashing wire jam nut. Then, the lashing wire jam nut and lashing wire are tightened against the messenger wire retaining nut. This secures the lashing wire to the cable clamp device and jams the messenger wire retaining nut in place. Thus, the cable clamp device mechanically fastens a telephone messenger wire and a lashing wire.

In the preferred embodiment, the messenger wire retaining nut is of a larger outer diameter than the lashing wire jam nut, thereby allowing a nut tightening tool of the proper dimension for adjusting the messenger wire retaining nut to pass over the threaded shank portion and the lashing wire jam nut. This permits the lashing wire jam nut to be threaded on the shank before the cable clamp is attached to the messenger wire, thereby simplifying clamp installation. Preferably, the dimensions of both nuts will be such that they correspond to standard sizes already carried by installers such as telephone linemen.

In another embodiment of the invention, the jaw portion of the hook member comprises a first curved portion connected to the threaded shank portion and a second wedge portion extending from the curved portion such that the threaded shank portion and the linear portion form an acute angle relative to the shank.

In still another embodiment of the invention, the jaw portion and the messenger wire retaining nut may have serrated or knurled surfaces to facilitate retention of the messenger wire.

In accordance with one aspect of the invention, an improved cable clamp is provided which is simple to install.

In accordance with another aspect of the invention, a cable clamp is provided which accommodates different diameters of messenger wire.

In accordance with yet another aspect of this invention, a cable clamp is provided which has reduced weight and cost.

In accordance with still another aspect of this invention, a cable clamp is provided which may be first secured to a messenger wire and then to a lashing wire, thereby eliminating the need for simultaneously holding all clamp components and both wires in the proper orientation for tightening.

Other objects and advantages of the invention will become apparent from the following detailed descriptions with references to the drawings. Throughout the drawings, like reference numerals refer to like parts.

BRIEF DESCRIPTION OF THE DRAWINGS

FIG. 1 is a perspective view of a cable clamp used to join a lashing wire to a messenger wire;

FIG. 2 is a side elevation of the embodiment shown in FIG. 1;

FIG. 3 is a bottom view of the hook member shown in FIG. 2 along line 3—3;

FIG. 4 is a side elevation of another embodiment of the invention in which the jaw portion which contacts the messenger wire is smooth;

FIG. 5 is a side elevation of the embodiment shown in FIG. 4 in which the jaw portion of the hook member retains a messenger wire of substantially smaller dimension than the recess formed by the jaw portion of the hook member;

FIG. 6 is a side elevation of another embodiment of the invention in which the jaw portion includes a plurality of teeth for contacting the messenger wire;

FIG. 7 is a bottom view of the embodiment shown in FIG. 6 taken along the line 7—7;

FIG. 8 is a side elevation of another embodiment of the invention in which the jaw portion comprises a first curved jaw portion and a second wedge jaw portion; and FIG. 9 is a bottom view of the embodiment shown in FIG. 8 taken along line 9—9.

DETAILED DESCRIPTION OF THE PREFERRED EMBODIMENT

Referring generally to all the Figures, and particularly to FIG. 1, an insulated signal wire 20 is secured to a messenger wire 22 by means of a lashing wire 24. Cable clamp 26 provides a mechanical connection between messenger wire 22 and lashing wire 24.

Referring now to FIG. 2, cable clamp 26 comprises a hook member 28, with a threaded shank portion 30 and a jaw portion 32 forming a trough, a messenger wire retaining nut 34, and a lashing wire jam nut 36. The threads on the shank portion extend substantially to the trough. The retaining nut 34, and a lashing wire jam nut 36. The jaw portion may take alternative forms as explained later. Messenger wire retaining nut 34 is threaded onto threaded shank portion 30 for the purpose of directly engaging and securing messenger wire 22 between jaw portion 32 and messenger wire retaining nut 34. In this embodiment, messenger wire retaining nut 34 contains a flanged end portion 38. The portion of messenger wire retaining nut 34 which contacts messenger wire 22 has a knurled surface 40. Preferably, knurled surface 40 contains no sharp edges which might abrade messenger wire 22. Avoiding such abrasion can prevent degradation of protective (galvanized) coatings which could lead to messenger wire corrosion. Such corrosion might limit wire service life or interfere with the removal of cable clamp 26. Additionally, jaw portion 32 has a serrated surface 42 where jaw portion 32 contacts messenger wire 22.

Threaded shank portion 30 also accepts lashing wire jam nut 36. Referring back to FIG. 1, lashing wire 24 is wrapped around threaded shank portion 30 between messenger wire retaining nut 34 and lashing wire jam nut 36. Lashing wire jam nut 36 is then tightened against messenger wire retaining nut 34 and lashing wire 24 to secure lashing wire 24 to cable clamp 26. Lashing wire jam nut 36 also jams messenger wire retaining nut 34 in place, thereby preventing the messenger wire retaining nut from working loose.

Preferably, messenger wire retaining nut 34 is of a greater outer diameter than lashing wire jam nut 36, thereby allowing a nut tightening tool of the proper dimension for tightening messenger wire retaining nut 34 to pass over threaded shank portion 30 and lashing wire jam nut 36. This permits lashing wire jam nut 36 to be threaded onto threaded shank portion 30 before tightening messenger wire retaining nut 34.

Referring now to FIG. 4, a cable clamp 46 includes a hook member 48 having a threaded shank portion 50 and a jaw portion 52. As in FIG. 3, a messenger wire retaining nut 54 and lashing wire jam nut 36 are threaded onto threaded shank portion 50. Messenger wire retaining nut 54 has a flanged end portion 58. However, unlike FIG.- 2, flanged end portion 58 contains a smooth trough 62 for contacting messenger wire 22.

Referring now to FIG. 5, cable clamp 46 is capable of retaining a messenger wire 64 of smaller diameter than the recess formed by jaw portion 52.

Turning next to FIG. 6, a cable clamp 66 again has a hook member 68 with a threaded shank portion 70 and a jaw portion 72. In this embodiment, a messenger wire retaining nut 54 and lashing wire jam nut 36 are threaded onto threaded shank portion 70. Jaw portion 72 has a toothed surface 82 with a plurality of teeth 84 which contact messenger wire 22.

Referring now to FIG. 8, a cable clamp 86 has a hook member 88 with a threaded shank portion 90 and a jaw portion 92. Messenger wire retaining nut 34 and lashing wire jam nut 36 are threaded onto threaded shank portion 90. Jaw portion 92 has a first curved wedge portion 102 which extends from threaded shank portion 90. First curved wedge portion 102 translates into a second wedge jaw portion 104. Both first curved wedge portion 102 and second wedge jaw portion 104 define a serrated surface 106 for the purpose of contacting messenger wire 22. In this embodiment, second wedge jaw portion 104 and threaded shank portion 92 form a wedge shaped recess with an acute angle A. The wedge shaped recess formed by second wedge jaw portion 104 and threaded shank portion 90 can accommodate messenger wire 22 of any diameter capable of being forced at least partially within the wedge when messenger wire retaining nut 40 is tightened.

While the invention is disclosed in connection with preferred embodiments, it will be understood that it is not intended to limit the invention to those embodiments. On the contrary, it is intended to cover all alternatives, modifications and equivalents as may be included in the intended scope of this invention as defined by the appended claims.

What is claimed is:

1. A cable clamp for mechanically fastening together a telephone messenger wire and a telephone lasing wire comprising:

a hook member with a threaded shank portion and a jaw portion, said jaw portion forming a trough for engaging the messenger wire, the threads on the threaded shank portion extending substantially to the trough;

a messenger wire retaining nut threadable on said threaded shank portion to directly engage and secure the messenger wire within said trough; and a lashing wire jam nut threadable on said threaded shank portion for retaining the lasing wire between said messenger wire retaining nut and said lasing wire jam nut when said lashing wire jam nut is tightened against said lashing wire.

2. The cable clamp of claim 1 wherein said messenger wire retaining nut comprises a flanged end portion for securing the messenger cable to said jaw portion.

3. The cable clamp of claim 1 wherein said messenger wire retaining nut has a knurled surface for contacting the messenger wire.

4. The cable clamp of claim 1 wherein said jaw portion comprises a curved extension of said threaded shank portion.

5. The cable clamp of claim 1 wherein said jaw portion comprises a first curved jaw portion extending from said threaded shank portion and a second wedge jaw portion extending tangentially from the end of said curved jaw portion opposite the end extending from said shank portion, said wedge jaw portion forming an acute angle relative to said shank.

6. The cable clamp of claim 1 wherein said jaw portion includes a serrated surface for contacting the messenger wire.

7. The cable clamp of claim 2 wherein said flanged end portion comprises a knurled surface for contacting the messenger wire.

8. The cable clamp of claim 7 wherein said jaw portion has a serrated surface for contacting the messenger wire.

9. The cable clamp of claim 1 wherein said jaw portion comprises a toothed surface having a plurality of teeth for contacting the messenger wire.

10. The cable clamp of claim 1 wherein said messenger wire retaining nut has a greater outer diameter than said lashing wire jam nut, whereby a nut tightening tool capable of tightening a nut of said messenger wire nut's radial dimension may pass over said lashing wire jam nut for the purpose of adjusting said messenger wire retaining nut without removing said lashing wire jam nut from said threaded shank portion.

11. The cable clamp of claim 10 wherein said messenger wire retaining nut comprises a flanged end portion, said end portion comprising a knurled surface for contacting the messenger wire.

12. A cable clamp for mechanically connecting together a telephone messenger wire and a telephone lashing wire comprising:

a hook member comprising a threaded shank portion and a jaw portion, said jaw portion forming a trough for engaging the messenger wire, the threads on the threaded shank portion extending substantially to the trough, said jaw portion comprising an extension of said threaded shank portion allowing the messenger wire to be depressed therein;

a messenger wire retaining nut with a flanged end portion, said messenger wire retaining nut threadable on said threaded shank portion to directly engage and secure the messenger wire between said trough and said flanged end portion; and a lashing wire jam nut threadable on said threaded shank portion for retaining the lasing wire between said lashing wire jam nut and said messenger wire retaining nut when said lashing wire jam nut is tightened against the lashing wire, said messenger wire retaining nut further having a greater outer diameter than said lashing wire jam nut, whereby a nut tightening tool capable of tightening a nut of said messenger wire nut's outer diameter may pass over said lashing wire jam nut for the purpose of adjusting said messenger wire retaining nut without removing said lashing wire jam nut from said threaded shank portion.

13. The cable clamp of claim jaw portion is U-shaped for receiving the messenger cable therein 14. The cable clamp of claim 12 wherein said jaw portion comprises a first curved portion of constant radius extending from said threaded shank portion and a second wedge jaw portion extending tangentially from the end of said first curved jaw portion opposite the end extending from said shank portion, said linear jaw portion and said threaded shank portion forming an acute angle.

15. The cable clamp of claim 12 wherein said flanged end portion comprises a knurled surface for contacting the messenger wire.

16. The cable clamp of claim 12 wherein said jaw portion comprises a serrated surface for contacting the messenger wire 17. The cable clamp of claim 12 wherein said jaw portion comprises a toothed surface having a plurality of teeth for contacting the messenger wire 18. A cable clamp for mechanically connecting together a telephone messenger wire and a telephone lashing wire comprising:

a hook member comprising a threaded shank portion and a jaw portion, said jaw portion forming a trough for engaging the messenger wire, the threads on the threaded shank portion extending substantially to the trough, said jaw portion comprising an extension of said threaded shank portion allowing the messenger wire to be depressed therein, said jaw portion further comprising a first curved jaw portion extending from said threaded shank portion and a second wedge jaw portion extending tangentially from the end of said curved jaw portion opposite the end extending from said shank portion, said wedge jaw portion, said curved jaw portion and said shank portion cooperating to form a wedge-shaped recess whereby messenger wires of various diameters can be retained by positioning the wire at least partially within said recess and between said jaw portion and said messenger wire retaining nut;

a messenger wire retaining nut comprising a flanged end portion threadable on said threaded shank portion to directly engage and secure the messenger wire between said flanged end portion and said trough, said flanged end portion further comprising a knurled surface for containing the messenger wire; and a lashing wire jam nut threadable on said threaded shank portion for retaining the lashing wire between said lashing wire jam nut, and said messenger wire retaining nut when said lashing wire jam nut is tightened against the lashing wire, said messenger wire retaining nut further having a greater outer diameter than said lashing wire jam nut, whereby a nut tightening tool capable of tightening a nut of said messenger wire nut's outer diameter may pass over said lashing wire jam nut for the purpose of adjusting said messenger wire retaining nut without removing said lashing wire jam nut from said threaded shank portion.

19. The cable clamp of claim 18 wherein said jaw portion comprises a serrated surface for contacting the messenger wire.

* * * * *